United States Patent [19]

Wedel

[11] Patent Number: 4,878,299

[45] Date of Patent: Nov. 7, 1989

[54] INSULATING APPARATUS FOR THERMALLY INSULATING A DRYER HEAD

[75] Inventor: Gregory L. Wedel, Beloit, Wis.

[73] Assignee: Beloit Corporation, Beloit, Wis.

[21] Appl. No.: 72,082

[22] Filed: Jul. 10, 1987

[51] Int. Cl.[4] ..... F26B 3/00

[52] U.S. Cl. ..... 34/35; 34/110; 34/108

[58] Field of Search ..... 34/108, 110, 35; 29/157

[56] References Cited

U.S. PATENT DOCUMENTS

| | | | |
|---|---|---|---|
| 1,640,855 | 8/1927 | Shlick | 34/110 |
| 2,817,908 | 12/1957 | Hornbostel | 34/110 |
| 4,385,454 | 5/1963 | Withers et al. | 34/110 |
| 4,399,169 | 8/1963 | McGowan | 34/110 X |
| 4,450,631 | 5/1984 | Gamble | 34/110 |
| 4,506,459 | 3/1985 | Swick | 34/110 |
| 4,520,578 | 6/1985 | Schiel et al. | 34/110 |

*Primary Examiner*—Henry A. Bennet

*Attorney, Agent, or Firm*—Dirk J. Veneman; Raymond W. Campbell; David J. Archer

[57] ABSTRACT

An insulating apparatus is disclosed for thermally insulating a dryer head journalled in a dryer section of a papermaking machine. The apparatus includes a stationary insulator having a disc-shaped configuration. The insulator defines a central bore for the rotatable reception therein of the journal. A peripheral seal extends circumferentially around the insulator for inhibiting the flow of convection currents past the periphery of the insulator thereby reducing thermal losses through the head.

14 Claims, 2 Drawing Sheets

INSULATING APPARATUS FOR THERMALLY INSULATING A DRYER HEAD

BACKGROUND OF THE INVENTION

1. FIELD OF THE INVENTION

This invention relates to an insulating apparatus for thermally insulating a dryer head journalled in a dryer section of a papermaking machine. More particularly, this invention relates to a stationary insulator for inhibiting the loss of heat from a drying cylinder of a papermaking machine.

2. INFORMATION DISCLOSURE STATEMENT

In the papermaking art, the formed, pressed web of paper is guided around a plurality of heated dryer drums in order to remove any excess moisture from the pressed web. Such dryer drums are heated by steam supplied to the inside of the rotatable dryer drums. Each dryer drum includes a cylindrical shell enclosed by opposed dryer heads rotatably journalled within support bearings. In use of the dryer drum, when steam is supplied to the inside of the rotatable dryer drum, heat is thermally conducted through the shell towards the paper web guided around the rotatable shell. However, a significant percentage of the thermal energy supplied to the dryer drum is conducted through the respective dryer heads and is lost by convection and radiation to the ambient surroundings.

In operation of a modern dryer section, the thermal energy requirements are very great and such heat losses through dryer heads can cause losses of up to 5% of the total energy requirements of such dryer sections. The provision of insulation adjacent to such dryer heads cause a resultant saving in the order of up to $33,000 per year.

Although several proposals have been set forth disclosing various means of fastening insulating covers to rotatable dryer heads, all of the prior art proposals show such insulating covers as being secured to the dryer head such that the insulating cover is rotatable.

Whereas, the provision of a rotatable insulator cover to a typical dryer drum having a 5 foot diameter may present relatively few problems, this is not the case when endeavoring to insulate the dryer heads of a Yankee Dryer or a machine-glazed (MG) cylinder which can be in the order of 8 to 25.5 feet in diameter. The provision of such a large rotating cover presents a potential hazard, particularly when applied to current Yankee and machine glazing dryer cylinders which operate at speeds of 3000 fpm or more. The rotating parts of the prior art insulator covers could cause harm or damage if they were to inadvertently contact personnel or adjacent equipment. In addition, in the event of an insulator cover rotating at this speed breaking away from a dryer, the results would be disastrous.

The present invention seeks to overcome the aforementioned potentially lethal situation by providing a stationary insulator having a sealing means disposed between the periphery of the insulator and the rotatable dryer head so that thermal losses are reduced and safety hazards are inhibited.

Therefore, it is a primary object of the present invention to provide an insulating apparatus for thermally insulating a dryer head which overcomes the aforementioned problems associated with the prior art proposals and which provides a significant contribution to the papermaking art.

Another object of the present invention is the provision of an insulating apparatus which includes a stationary insulator having a disc-shaped configuration with a central bore for the rotatable reception therein of the dryer head journal.

Another object of the present invention is the provision of an insulating apparatus which includes a peripheral sealing means which extends circumferentially around the insulator for inhibiting the flow of convection currents past the periphery of the insulator thereby reducing thermal losses through the head.

Another object of the present invention is the provision of an insulating apparatus which includes an air cap which is disposed adjacent to the dryer head with the air cap extending around a portion of the circumference of the dryer and a flexible seal which physically contacts, and sealingly engages, the air cap for inhibiting the flow of convection currents from the dryer head past the flexible seal.

Another object of the present invention is the provision of an insulating apparatus in which the diameter of the insulator is greater than the diameter of the dryer head such that when the air cap is retracted away from the dryer head, the flexible seal still maintains sealing engagement with the air cap.

Other objects and advantages of the present invention will be apparent to those skilled in the art by a consideration of the detailed description contained hereinafter taken in conjunction with the annexed drawings.

SUMMARY OF THE INVENTION

The present invention relates to an insulating apparatus and method for thermally insulating a dryer head journalled in a dryer section of a papermaking machine. The apparatus includes a stationary insulator having a disc-shaped configuration. The insulator defines a central bore for the rotatable reception therein of the journal. A peripheral sealing means extends circumferentially around the insulator for inhibiting the flow of convection currents past the periphery of the insulator thereby reducing thermal losses through the head.

In a more specific embodiment of the present invention, the stationary insulator defines a first and a second face. A stainless steel cover having a disc-shaped configuration cooperates with, and is disposed contiguous with, the first face of the insulator.

The peripheral sealing means also includes an annular rim and fastening means for fastening the rim to the periphery of the insulator. A flange means is secured to, and extends away from, the rim. The flexible seal means is secured to the flange means for sealing the periphery of the insulator relative to the head. The flange means includes a first and a second flange which extend coaxially relative to the rim.

In an alternative embodiment of the present invention, the flange means includes a flange which extends radially away from the rim.

In one embodiment of the present invention, the flexible seal means physically contacts, and sealingly engages, the rotatable dryer head thereby inhibiting the flow of convection currents past the flexible seal means.

In an alternative embodiment of the present invention, an air cap is disposed adjacent to the dryer head with the air cap extending around a portion of the circumference of the dryer head. The flexible seal means physically contacts, and sealingly engages, the air cap for inhibiting the flow of convection currents from the dryer head past the flexible seal means. The flexible seal means includes a first and a second seal with the seals being of annular configuration and coaxial relative to each other. The seals are fabricated from felt, or felt like material, and the diameter of the insulator is greater than the diameter of the dryer head such that the difference between the diameter of the insulator and the diameter of the dryer head is such that when the air cap is retracted from the dryer head, the flexible seal means still maintains sealing engagement with the air cap.

As will be appreciated by those skilled in the art, many modifications and variations may be made to the preferred embodiment, however these modifications do not depart from the spirit and scope of the present invention as defined by the appended claims.

BRIEF DESCRIPTION OF THE DRAWINGS

Similar reference characters refer to similar parts throughout the various embodiments of the present invention.

DETAILED DESCRIPTION OF THE DRAWINGS

Figure 1:
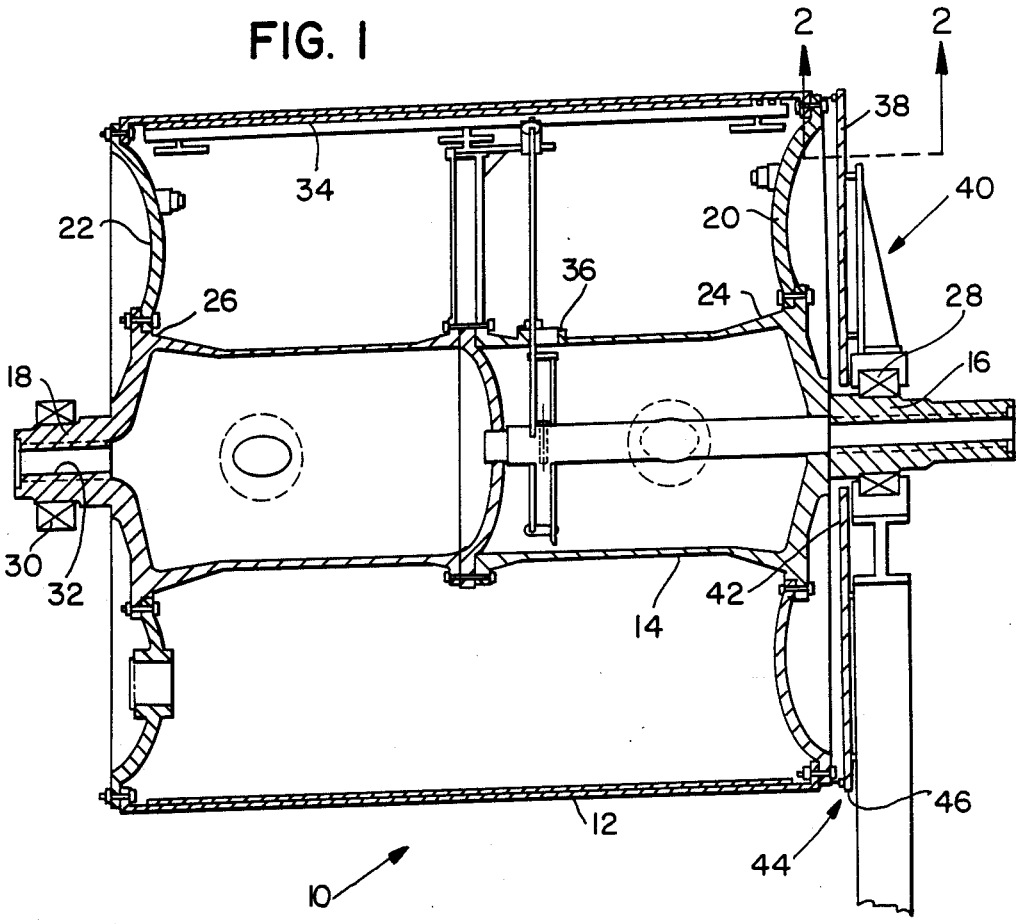
FIG. 1 is a sectional view of a typical dryer drum showing the stationary insulator according to the present invention.

FIG. 1 is a sectional view of a typical Yankee Dryer generally designated 10. The dryer 10 includes a cylindrical shell 12 for guiding a paper web (not shown) thereabout. The dryer 10 also includes a hollow central body portion 14 having journals 16 and 18 extending axially therefrom. A first and a second dryer head 20 and 22 extend respectively from the first and second end 24 and 26 of the body portion 14 and are secured to the shell 12 such that the shell 12 is able to rotate with the dryer heads 20 and 22 and body portion 14 within support bearings 28 and 30 of the dryer 10. Steam is introduced into the hollow body portion 14 by means of a centrally-disposed supply pipe 32. This steam communicates with the inner surface 34 of the shell 12 by means of a hole 36 extending through the body portion 14. While thermal energy is conducted through the shell 12 to dry the paper web, as much as 5% of the thermal energy is able to be lost through the exposed dryer heads 20 and 22 respectively. As shown in FIG. 1, such heat loss through the dryer head 20 is minimized by the provision of a stationary insulator 38 which is disposed adjacent to the dryer head 20 for inhibiting the flow of convection currents away from the dryer head 20.

More specifically, an insulating apparatus generally designated 40 thermally insulates the dryer head 20 which is journalled in the dryer section of the papermaking machine. The apparatus 40 includes the stationary insulator 38 which is of disc-shaped configuration. The insulator 38 defines a central bore 42 for the rotatable reception therein of the journal 16. A peripheral sealing means generally designated 44 extends circumferentially around the insulator 38 for inhibiting the flow of convection currents past the periphery 46 of the insulator 38 thereby reducing thermal losses through the head 20.

Figure 2:
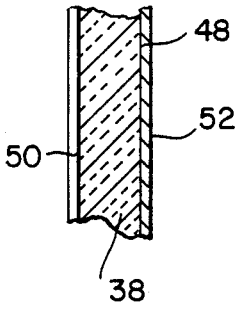
FIG. 2 is an enlarged sectional view taken on the line 2—2 of FIG. 1.

As shown in FIG. 2, the stationary insulator 38 defines a first and second face 48 and 50 respectively and a metallic stainless steel cover 52 of disc-shaped configuration cooperates with, and is disposed contiguous with, the first face 48 of the insulator 38.

Figure 3:
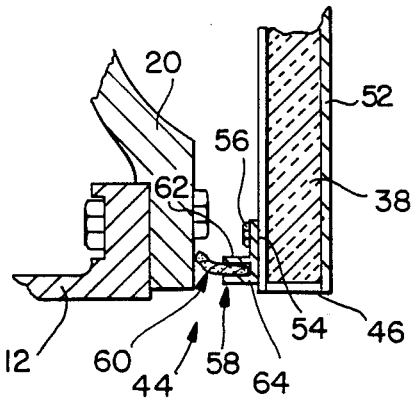
FIG. 3 is an enlarged sectional view of the peripheral sealing means shown in FIG. 1.

FIG. 3 is an enlarged sectional view of a portion of the peripheral sealing means 44 which includes an annular rim 54 with fastening means 56 for fastening the rim 54 to the periphery 46 of the insulator 38. Flange means generally designated 58 are secured to, and extend away from, the rim 54. Flexible seal means generally designated 60 are secured to the flange means 58 for sealing the periphery 46 of the insulator 38 relative to the dryer head 20.

As shown in FIG. 3, the flange means 58 includes a first and second flange 62 and 64 which extend coaxially relative to each other and away from the rim 54. The flexible seal means 44 physically contacts, and sealingly engages, the rotatable dryer head 20 thereby inhibiting the flow of convection currents past the flexible seal means 44.

Figure 4:
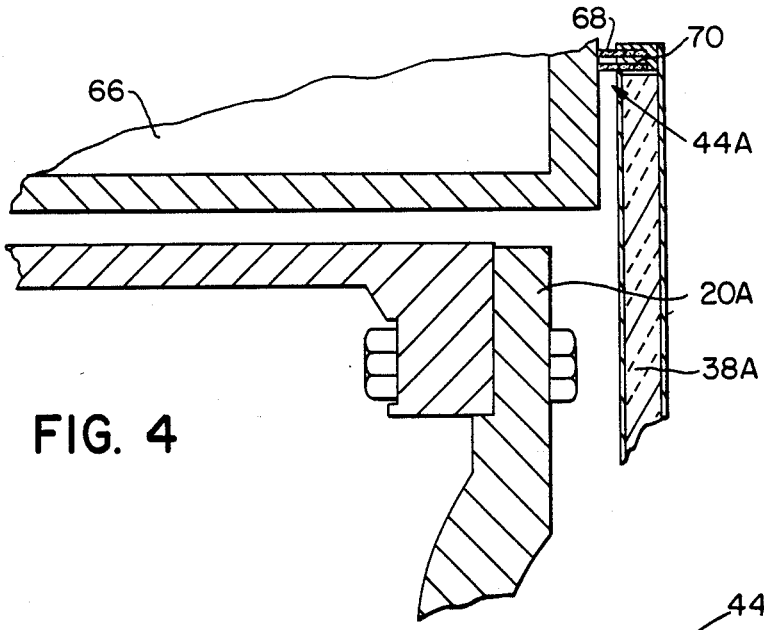
FIG. 4 is a fragmentary sectional view of an alternative embodiment of the present invention showing an air cap disposed adjacent to the dryer head with the air cap in an operative position relative to the dryer.

FIG. 4 shows an alternative embodiment of the present invention in which an air cap 66 is disposed adjacent to the dryer head 20A. The air cap 66 extends around a portion of the circumference of the dryer head 20A and the flexible seal means 44A physically contacts and sealingly engages the air cap 66 for inhibiting the flow of convection currents from the dryer 20A head past the flexible seal means 44A. As shown in FIG. 4, the flexible seal means 44A includes a first and a second seal 68 and 70 respectively with the first and second seals 68 and 70 being of annular configuration and coaxial relative to each other. These seals 68 and 70 may be fabricated from felt.

Figure 5:
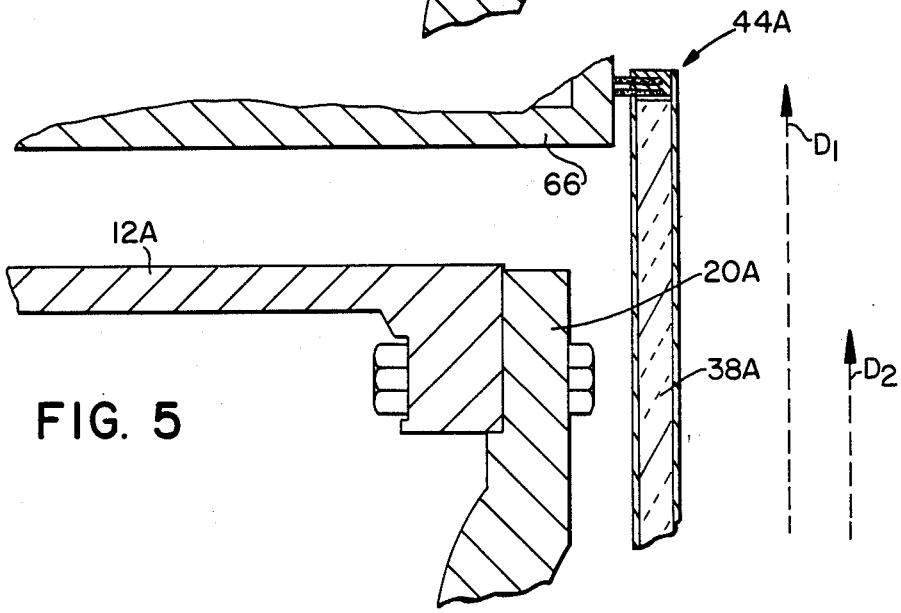
FIG. 5 is a sectional view similar to that shown in FIG. 4 but with the air cap in the retracted position.

FIG. 5 is a view familiar to the view shown in FIG. 4 but shows the air cap 66 retracted away from the dryer head 20A and shell 12A. The diameter D1 of the insulator 38A is greater than the diameter D2 of the dryer head 20A with the difference between the diameter D1 of the insulator 38A and the diameter D2 of the dryer head 20A being such that when the air cap 66 is retracted away from the dryer head 20A the flexible seal means 44A still maintains sealing engagement with the air cap 66 as shown.

Figure 6:
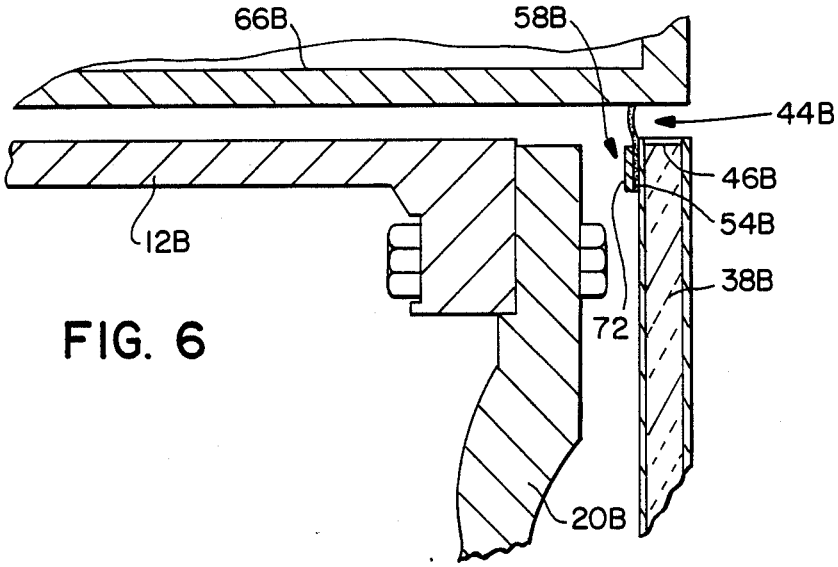
FIG. 6 is an alternative embodiment of the present invention showing a fixed air cap with an alternative peripheral sealing means.

FIG. 6 shows a further embodiment of the present invention including a stationary air cap 66B with the flexible sealing means 44B extending between the periphery 46B of the insulator 38B and the air cap 66B. The flange means 58B includes a flange 72 which extends radially away from a rim 54B.

In operation of the insulating apparatus according to the preferred embodiment of the present invention, the dryer heads 20 and 22 and shell 12 rotate within the bearings 28 and 30 respectively but the insulator 38 is disposed stationary relative to the rotatable dryer. The peripheral sealing means 44 prevent the flow of convection currents therepast, thereby reducing thermal losses through the respective dryer heads.

The present invention avoids the danger of having a heavy and sizable cover rotating at high speed coming adrift relative to a dryer. Furthermore, with the prior art rotatable insulators, there existed a tendency for the insulation to settle and become thrown by centrifugal force outwardly thereby reducing the thermal insulation of the apparatus. Additionally, the present invention enables the provision of a manhole at a fixed location such that inspection of the dryer head and code plates thereon is readily accessible. Further, with the prior art rotatable insulators, difficulties were experienced with inspecting the heads of the dryers for leaks and cracks. The present invention enables simple attachment of the insulator relative to the dryer head with no necessity for attachment bosses on the dryer heads.

What is claimed is:

1. An insulating apparatus for thermally insulating a dryer head journalled in a dryer section of a papermaking machine, said apparatus comprising:

a stationary insulator having a disc-shaped configuration, said insulator defining a central bore for the rotatable reception therein of the journal.

2. An insulating apparatus for thermally insulating a dryer head journalled in a dryer section of a papermaking machine, said apparatus comprising:

a stationary insulator having a disc-shaped configuration, said insulator defining a central bore for the rotatable reception therein of the journal; and a peripheral sealing means extending circumferentially around said insulator for inhibiting the flow of convection currents past the periphery of said insulator thereby reducing thermal losses through the head.

3. An insulating apparatus as set forth in claim 2 wherein the stationary insulator defines a first and a second face;

a metallic cover having a disc-shaped configuration cooperating with, and disposed contiguous with, said first face of said insulator.

4. An insulating apparatus as set forth in claim 3 wherein said metallic cover is fabricated from stainless steel.

5. An insulating apparatus as set forth in claim 2 wherein said peripheral sealing means further includes:

an annular rim;

fastening means for fastening said rim to the periphery of said insulator;

flange means secured to and extending away from said rim;

flexible seals means secured to said flange means for sealing the periphery of said insulator relative to the dryer head.

6. An insulating apparatus as set forth in claim 5 wherein said flange means includes a first and a second flange which extend coaxially relative to said rim.

7. An insulating apparatus as set forth in claim 5 wherein said flange means includes a flange which extends radially away from said rim.

8. An insulating apparatus as set forth in claim 5 wherein said flexible seal means extends between the dryer head and said insulator and sealingly engages, the rotatable dryer head thereby inhibiting the flow of said currents past said flexible seal means.

9. An insulating apparatus as set forth in claim 5 further including:

an air cap disposed adjacent to said dryer head, said air cap extending around a portion of the circumference of the dryer head;

said flexible seal means physically contacting, and sealingly engaging, said air cap for inhibiting the flow of said currents from the dryer head past said flexible seal means.

10. An insulating apparatus for thermally insulating a dryer head journaled in a dryer section of a papermaking machine, said apparatus comprising:

a stationary insulator having a disc-shaped configuration, said insulator defining a central bore for the rotatable reception therein of the journal;

a peripheral sealing means extending circumferentially around said inventor for inhibiting the flow of convection currents past the periphery of said insulator thereby reducing thermal losses through the head;

said peripheral sealing means further including:

an annular rim;

fastening means for fastening said rim to the periphery of said insulator;

flange means secured to and extending away from said rim;

flexible seal means secured to said flange means for sealing the periphery of said insulator relative to the dryer head;

said insulating apparatus further including:

an air cap disposed adjacent to said dryer head, said air cap extending around a portion of the circumference of the dryer head;

said flexible seal means physically contacting, and sealingly engaging, said air cap for inhibiting the flow of said currents from the dryer head past said flexible seal means; and said flexible seal means including:

a first and a second seal, said first and second seals being of annular configuration and coaxial relative to each other.

11. An insulating apparatus as set forth in claim 10 wherein said first and second seal is fabricated from a flexible material.

12. An insulating apparatus as set forth in claim 9 wherein the diameter of said insulator is greater than the diameter of the dryer head, the difference between the diameter of said insulator and the diameter of the dryer head being such that when the air cap is retracted away from the dryer head, said flexible seal means still maintains sealing engagement with said air cap.

13. A method of thermally insulating a dryer head journalled in a dryer section of a papermaking machine, the method comprising the step of:

fastening a stationary insulator adjacent to the dryer head for inhibiting radiation losses from the head and inhibiting the flow of convection currents past the periphery of the insulator thereby reducing thermal losses through the head.

14. A method of thermally insulating a dryer head as set forth in claim 13 further including the step of:

sealing the periphery of the insulator relative to the dryer head so that the convection currents are unable to flow from the dryer head past the insulator.

* * * * *